US006941587B1

(12) United States Patent
Fletcher

(10) Patent No.: US 6,941,587 B1
(45) Date of Patent: Sep. 13, 2005

(54) STABLE ERGONOMIC URINAL FOR BEDRIDDEN INDIVIDUALS

(75) Inventor: Henry Fletcher, 3052 Boeing Rd., Cameron Park, CA (US) 95682

(73) Assignee: Henry Fletcher, Cameron Park, CA (US)

( * ) Notice: Subject to any disclaimer, the term of this patent is extended or adjusted under 35 U.S.C. 154(b) by 0 days.

(21) Appl. No.: 10/671,988

(22) Filed: Sep. 26, 2003

Related U.S. Application Data

(60) Provisional application No. 60/414,309, filed on Sep. 26, 2002.

(51) Int. Cl.[7] ..... A47K 11/00

(52) U.S. Cl. ..... 4/144.3; 4/144.1; 604/327; 604/329

(58) Field of Search ..... 4/144.1–144.4; 604/327–332, 604/347

(56) References Cited

U.S. PATENT DOCUMENTS

| | | | | | |
|---|---|---|---|---|---|
| 661,403 | A | | 11/1900 | Hogan | 4/144.3 |
| 1,758,236 | A | * | 5/1930 | Olson et al. | 4/144.4 |
| 1,767,240 | A | * | 6/1930 | Mercie et al. | 4/144.1 |
| 2,542,276 | A | * | 2/1951 | Felts | 4/144.3 |
| 3,030,636 | A | * | 4/1962 | Evans | 4/144.3 |
| D213,408 | S | | 2/1969 | Brodsky et al. | D83/1 |
| 3,473,172 | A | * | 10/1969 | Friedman et al. | 4/144.3 |
| 3,479,671 | A | | 11/1969 | Beich | 4/144.1 |
| 3,568,218 | A | | 3/1971 | Beckman | 4/144.1 |
| 3,579,653 | A | * | 5/1971 | Kuhn | 4/144.2 |
| 3,727,244 | A | * | 4/1973 | Collins | 4/144.3 |
| 3,927,426 | A | * | 12/1975 | Geddes | 4/144.3 |
| 4,050,103 | A | * | 9/1977 | Nakao et al. | 4/144.3 |
| 4,164,795 | A | | 8/1979 | Johnson | 4/144.1 |
| 4,270,231 | A | | 6/1981 | Zint | 4/144.1 |
| 4,309,779 | A | | 1/1982 | Knight | 4/144.3 |
| D289,690 | S | | 5/1987 | Hanson | D24/54 |
| 4,665,571 | A | | 5/1987 | Muccione | 4/144.1 |
| 4,707,864 | A | * | 11/1987 | Ikematsu et al. | 4/144.3 |
| 4,769,858 | A | | 9/1988 | Gamm et al. | |
| 5,010,599 | A | | 4/1991 | Nilsson | 4/144.2 |
| 5,343,570 | A | | 9/1994 | Arpaia et al. | 4/144.1 |
| 5,592,699 | A | | 1/1997 | Jensen | 4/144.3 |
| D389,240 | S | | 1/1998 | Corona | D24/122 |
| D390,657 | S | | 2/1998 | Asta | D23/302 |
| 5,797,147 | A | | 8/1998 | Young et al. | 4/144.1 |
| 5,953,763 | A | | 9/1999 | Gouget | 4/144.1 |
| D429,321 | S | | 8/2000 | Gouget | D23/302 |
| 6,109,441 | A | | 8/2000 | Anderson | 206/526 |
| D430,655 | S | | 9/2000 | Anderson | D23/302 |
| 6,119,280 | A | | 9/2000 | Rentsch | 4/144.1 |
| 6,401,263 | B2 | | 6/2002 | Chang | 4/144.1 |
| 6,460,199 | B1 | | 10/2002 | Sands | 4/144.3 |
| 6,588,024 | B2 | | 7/2003 | Koelliker et al. | 4/144.1 |

* cited by examiner

*Primary Examiner*—Khoa D. Huynh
(74) *Attorney, Agent, or Firm*—Silicon Edge Law Group LLP.; Arthur J. Behiel

(57) ABSTRACT

A unisex, portable urinal for bedridden individuals. The urinal has a generally triangular shape for stability and to reduce urine levels, both of which prevent spillage. A handle configuration helps users properly position the urinal, for example in a manner that forms a good seal against the relevant portion of the female anatomy. Both male and female users benefit from stable urine storage and a comfortable, ergonomic form.

11 Claims, 7 Drawing Sheets

STABLE ERGONOMIC URINAL FOR BEDRIDDEN INDIVIDUALS

This application claims the benefit of Provisional Application No. 60/414,309, filed Sep. 26, 2002.

BACKGROUND

Portable urinals have long been used to collect urine from bedridden individuals, whether at home or in hospitals. Urinating while confined to a bed is difficult, particularly for those with limited mobility. Urinal users and their caregivers thus frequently encounter spills and leakage, leading to embarrassment, discomfort, and the need to change and launder bedding. Laundering bedding is costly and time consuming, and moving bedridden patients as necessary to change bedding can be uncomfortable or even dangerous for the patient and caregiver. These disadvantages often lead caregivers to resort to catheterization, an uncomfortable and embarrassing procedure that can lead to dangerous urinary-tract infections.

Many conventional urinals address one or more of these problems using a variety of configurations. Unfortunately, users of these urinals still suffer embarrassment, discomfort, and expense as a result of unstable, ill-fitted urinals. There is therefore a need for comfortable, spill-resistant portable urinals that are easily manipulated by those in need of a urinal and their caregivers.

SUMMARY

The present invention is directed to a unisex, portable urinal for bedridden individuals, or "users." Individuals employing urinals in accordance with embodiments of the invention can do so in a variety of positions, such as when lying flat on their backs, on their backs with knees raised, or sitting up. Some embodiments have handle and body configurations that help users properly position the urinal, for example in a manner that forms a good seal against the relevant portions of the female anatomy. Both male and female users benefit from stable urine storage, easy urinal positioning, and a comfortable, ergonomic form.

This summary does not limit the invention, which is instead defined by the claims.

DETAILED DESCRIPTION

Figure 1:
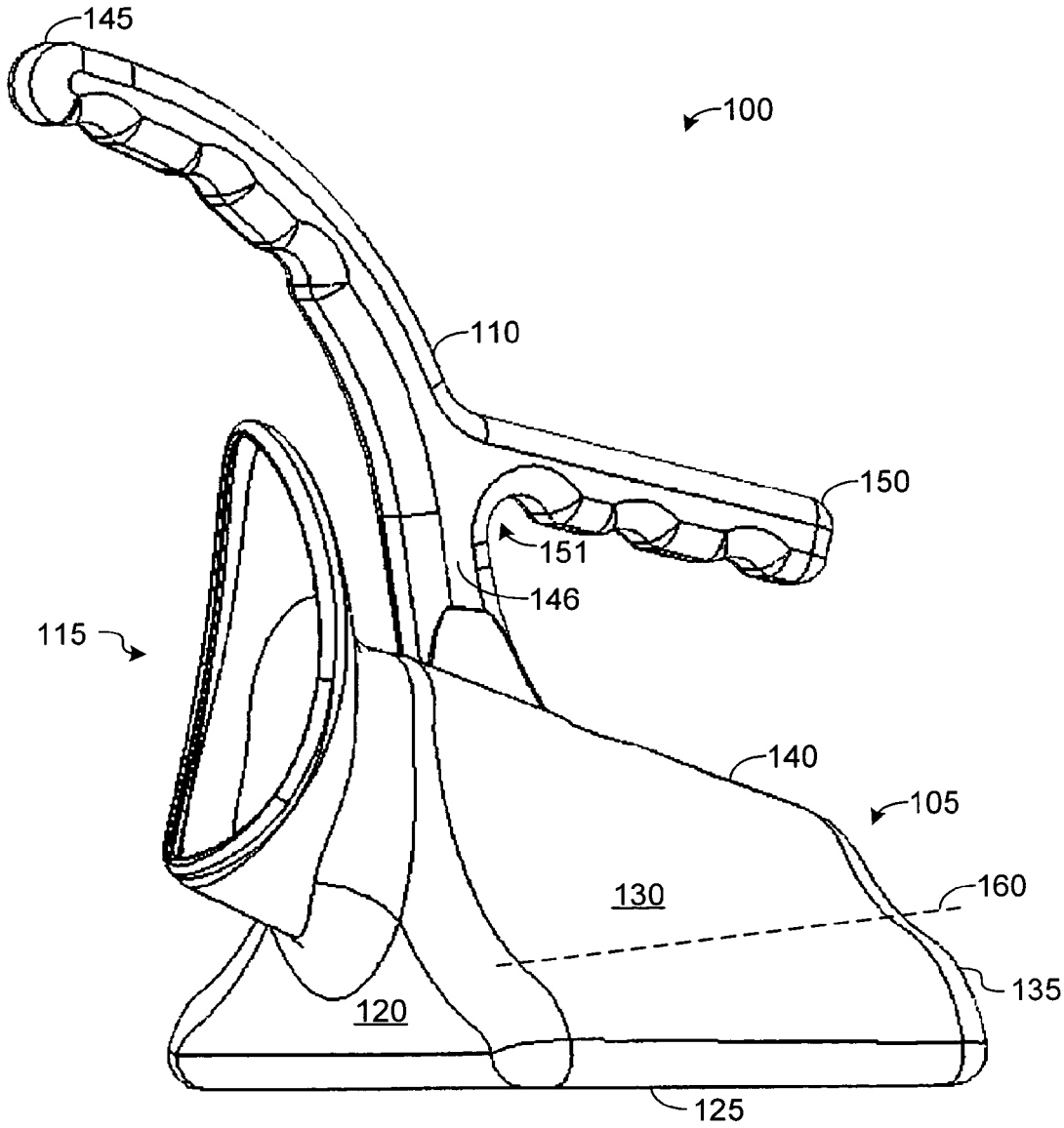
FIGS. 1 and 2 depict a urinal bottle 100 from different angles to illustrate various features.

FIG. 1 depicts a urinal bottle 100 in accordance with one embodiment. Urinal bottle 100 includes a body 105 to which is attached a handle 110. A mouth 115 in a first end 120 of body 105 has a "saddle" shape that facilitates formation of a tight seal against the relevant portion of the female anatomy. In the depicted embodiment, the top portion of mouth 115 has a tighter radius than the bottom portion, a shape that has been found to form a tight, comfortable seal against a broad range of users.

Body 105 includes a base 125, a pair of sidewalls 130, and a second end 135 opposite first end 120. As is more clearly shown in later figures, sidewalls 130 meet at a crest 140 such that sidewalls 130, first and second ends 120 and 135, and base 125 collectively form an interior cavity for collecting urine received via mouth 115.

Handle 110 connects to crest 140 via a connecting portion 146, and includes a proximal end 145 and a distal end 150, where "proximal" and "distal" are defined with respect to the hands of a user. Proximal end 145 is located forward of mouth 115 to allow users to comfortably position urinal bottle 100 without a caregiver or to allow the user to assist the caregiver in establishing a good seal. This is an important aspect of bottle 100, as the user receives tactile feedback regarding urinal placement and can therefore aid in forming a good seal. Distal end 150 may be more convenient for the caregiver, and can be used either separately or in conjunction with proximal end 145.

Both proximal and distal portions of handle 110 include a series of depressions designed provide a secure grip. Bottle 100 can also be hung in a relatively balanced position using the innermost depression 151 associated with distal end 150. In other embodiments, bottle 100 includes different handle configurations, such as a handle with only a distal portion or only a proximal portion.

First end 120 and second end 135 of body 105 are very roughly triangular. This shape causes the user's legs to hold bottle 100 stably in place and provides a lower center of gravity, thus reducing the probability of tipping and consequent spillage. Also important, storing the majority of urine below the user's legs maintains the surface of the urine well below mouth 115, further reducing the probability of spillage.

The shapes of the first and second ends 120 and 135 can be made so that sidewalls 130 are concaved. This shape fits more comfortably between a user's legs, as described below in connection with FIG. 3. As show in FIG. 1, the lower portion of second end 135 extends upward from base 125 at a steeper gradient than the lower portion of first send 120, which causes the lower portion of body 105 to have a wedge shape, indicated by a dotted line 160, that tapers down toward mouth 115. The shape, when a user's legs are applied to sidewalls 130, forces the lower lip of mouth 115 up and against the user's perineum, which may provide a better seal for some users. In other embodiments, the shapes of the first and second ends 120 and 135 are altered to change the angle of this wedge. The angle can be eliminated, or the body 105 can be shaped so the base of bottle 100 tapers down away from mouth 115 instead of up and away as shown.

Figure 2:
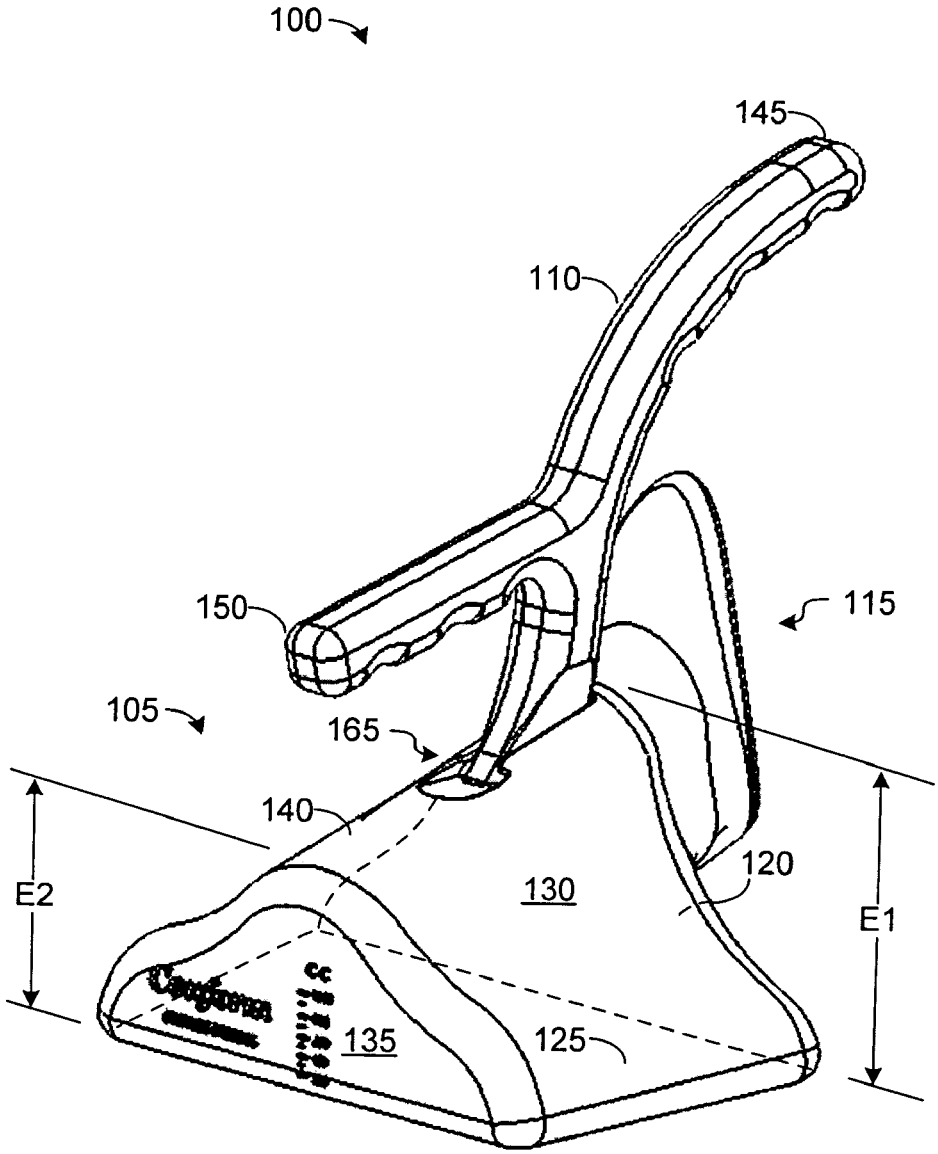

FIG. 2 depicts urinal bottle 100 from another angle to more clearly illustrate various features. For example, handle 110 is shown to attach to crest 140 of body 105 via a tongue-and-groove connection 165. Handle 110 may be removed to reduce the volume required for storing and shipping bottle 100. Some embodiments employ a handle that fits within body 105 when not in use.

Also apparent in FIG. 2, the roughly triangular cross-sectional area of body 105 tapers down from first end 120 toward second end 135. When positioned between a user's legs, this general taper tends to urge mouth 115 against the user to form a more effective seal. In this embodiment, base 125 approximates a trapezoid with parallel edges joining sides 120 and 135. The edge of base 125 intersecting side 120 is longer than the edge intersecting side 135 in this example. The elevation E1 of side 135 is less than the elevation E2 of side 120. Body 105 thus tapers down away from mouth 115 in both height and width. Second end 135 is relatively flat and includes graduations for measuring urine levels. Body 105 is entirely or partially formed of translucent material so urine can be measured against the graduations. In one embodiment, bottle 105 is of a blow-molded thermoplastic.

Figure 3:
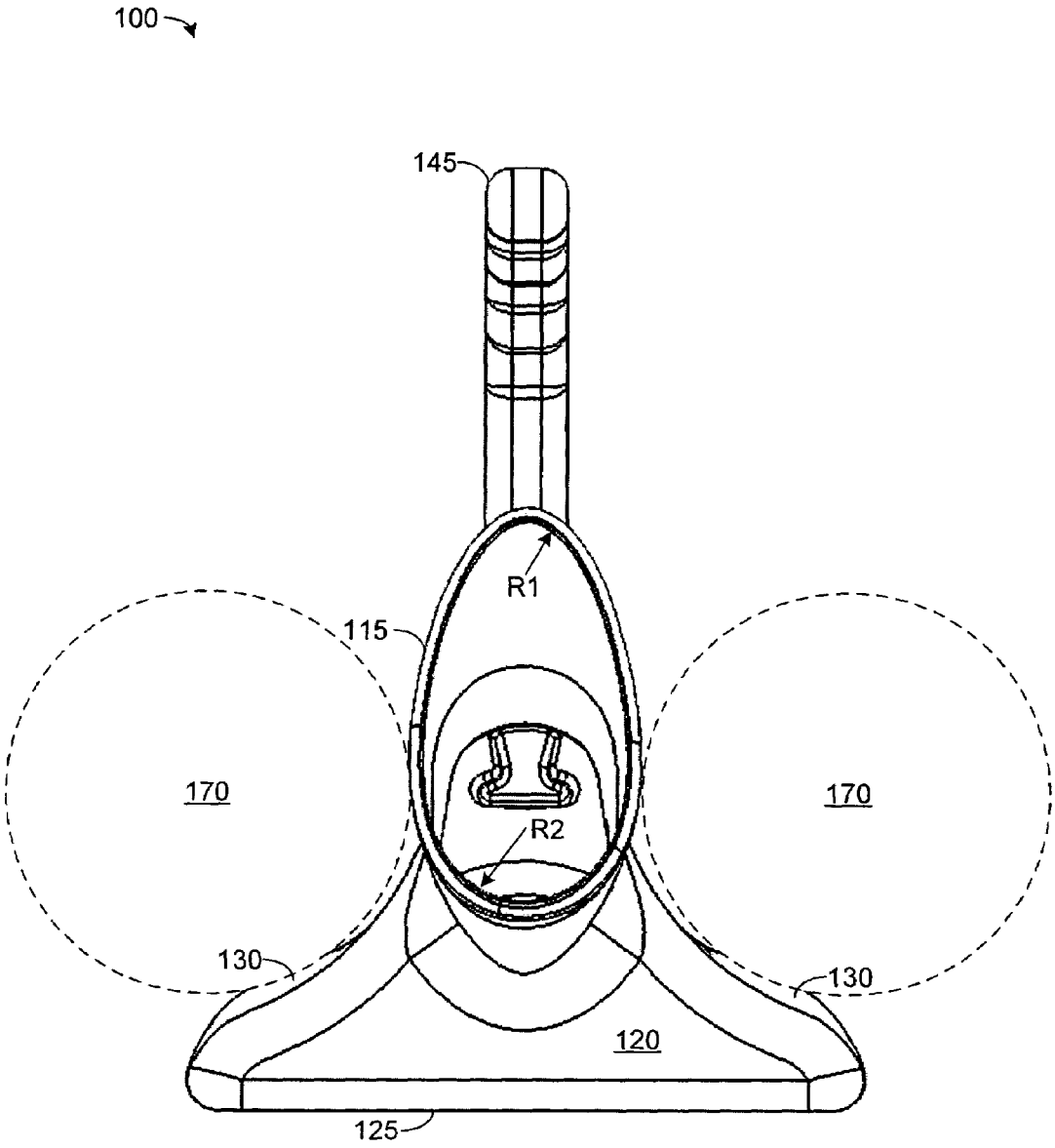
FIG. 3 depicts urinal bottle 100 from a perspective facing the mouth of the bottle and includes cross-sections of a user's leg to illustrate the positioning of bottle 100.

FIG. 3 depicts urinal bottle 100 from a perspective facing mouth 115. This perspective shows how the relatively convex cross-sections of a user's legs 170 form fit to the concave sidewalls 130, forcing base 125 down against the user's bed to stabilize bottle 100 and prevent spillage. FIG. 3 also illustrates how proximal end 145 of handle 110 is presented to the user over mouth 115 in a manner that allows bedridden users to position or aid in positioning mouth 115. FIG. 3 also details the egg-shape form of mouth 115 from this perspective, in which the top portion of mouth 115 is of a smaller radius R1 than the bottom portion of radius R2.

Figure 4:
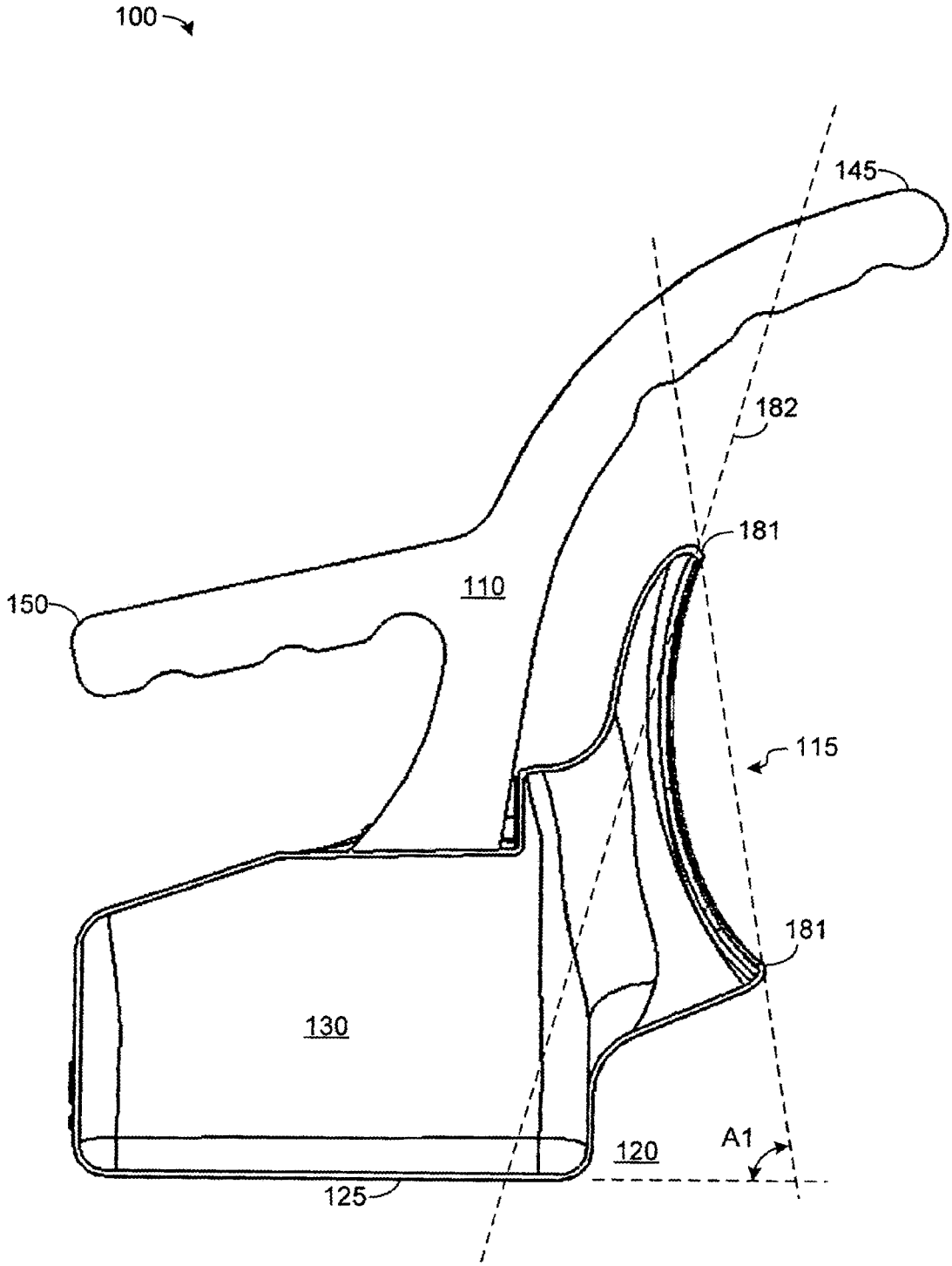
FIG. 4 is a side view of bottle 100 detailing the position of the mouth of bottle 100 with respect to the handle.

FIG. 4 is a cross-sectional side view of bottle 100 cut along crest 140 and bisecting handle 110 and mouth 115. This view details the orientation of mouth 115 and inward rolled lip 181. From this perspective, mouth 115 has a saddle shape that conforms to the corresponding portion of the female anatomy. Lip 181 is rolled inward to increase the size of the area contacting the user for greater comfort. The rolled-in lip 181 additionally serves as a dam to prevent urine from sloshing out of mouth 115. Other embodiments additionally include one or more additional dams to further reduce the possibility of spillage. The general saddle shape of mouth 115 is tilted slightly back away from the user, thus forming an acute angle A1 with respect to the plane defined by base 125. This mouth configuration has been found to promote a comfortable seal and reduce leakage when bottle 100 is pulled away from the user. Proximal end 145 of handle 110 extends over mouth 115 in this embodiment so, as show by dashed line 182, the upper portion of mouth 115 lies between proximal end 145 and base 125.

Figure 5:
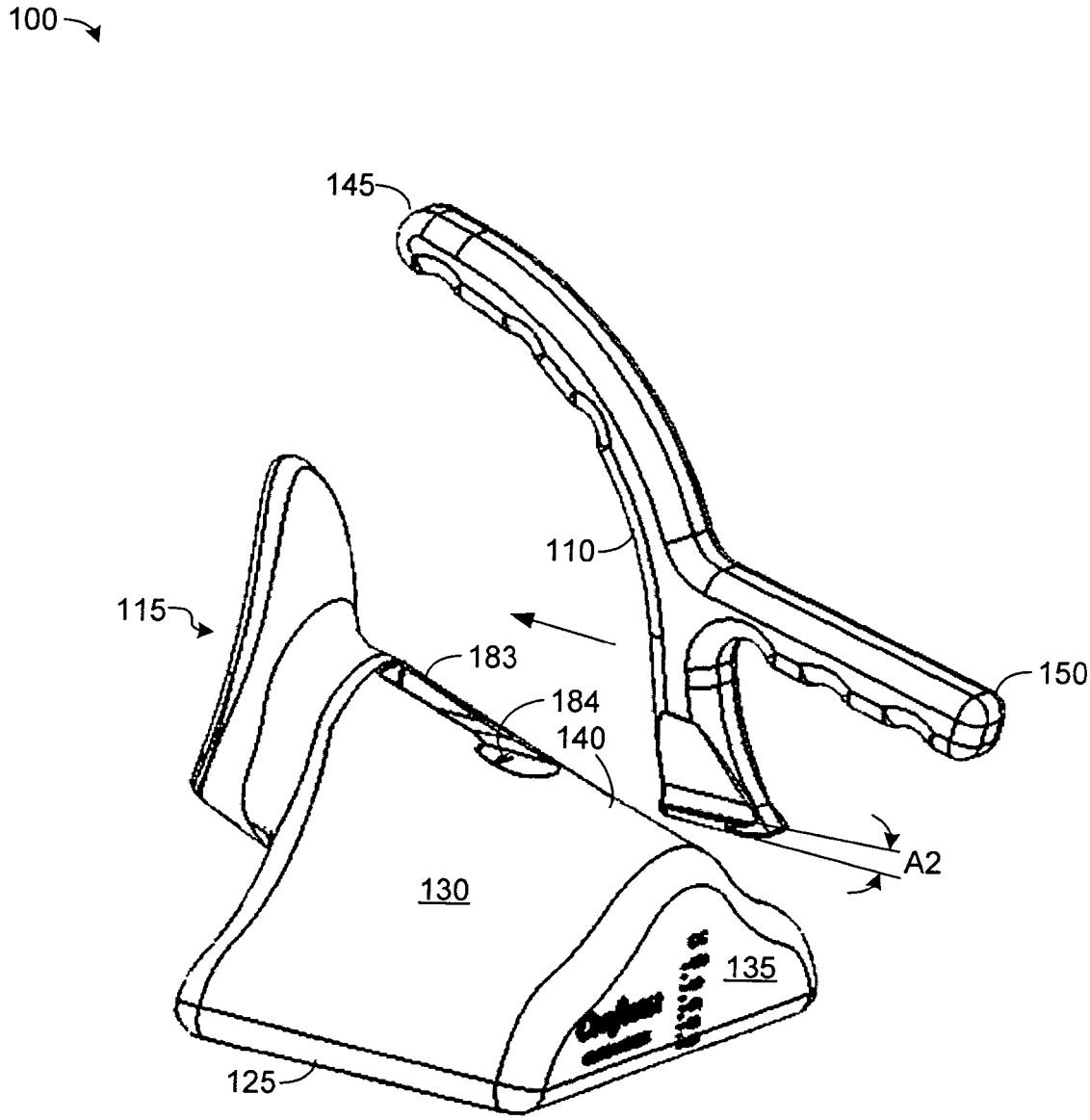
FIG. 5 is another perspective of bottle 100, this one showing the handle removed from the body.

FIG. 5 is another perspective of bottle 100, this one showing handle 110 removed from body 105. The base of handle 110 is wedge-shaped to mount solidly in the corresponding groove 183 in crest 140. Handle 110 mounts into groove 183 in the direction of the user, so that pulling on handle 110 to form a seal between the user and mouth 115 does not dislodge handle 110. A small protrusion 184 snaps up behind handle 110 to secure handle 110 in groove 183. These aspects of the depicted embodiment minimize the chance of accidental separation of handle 110 and body 105.

Figure 6:
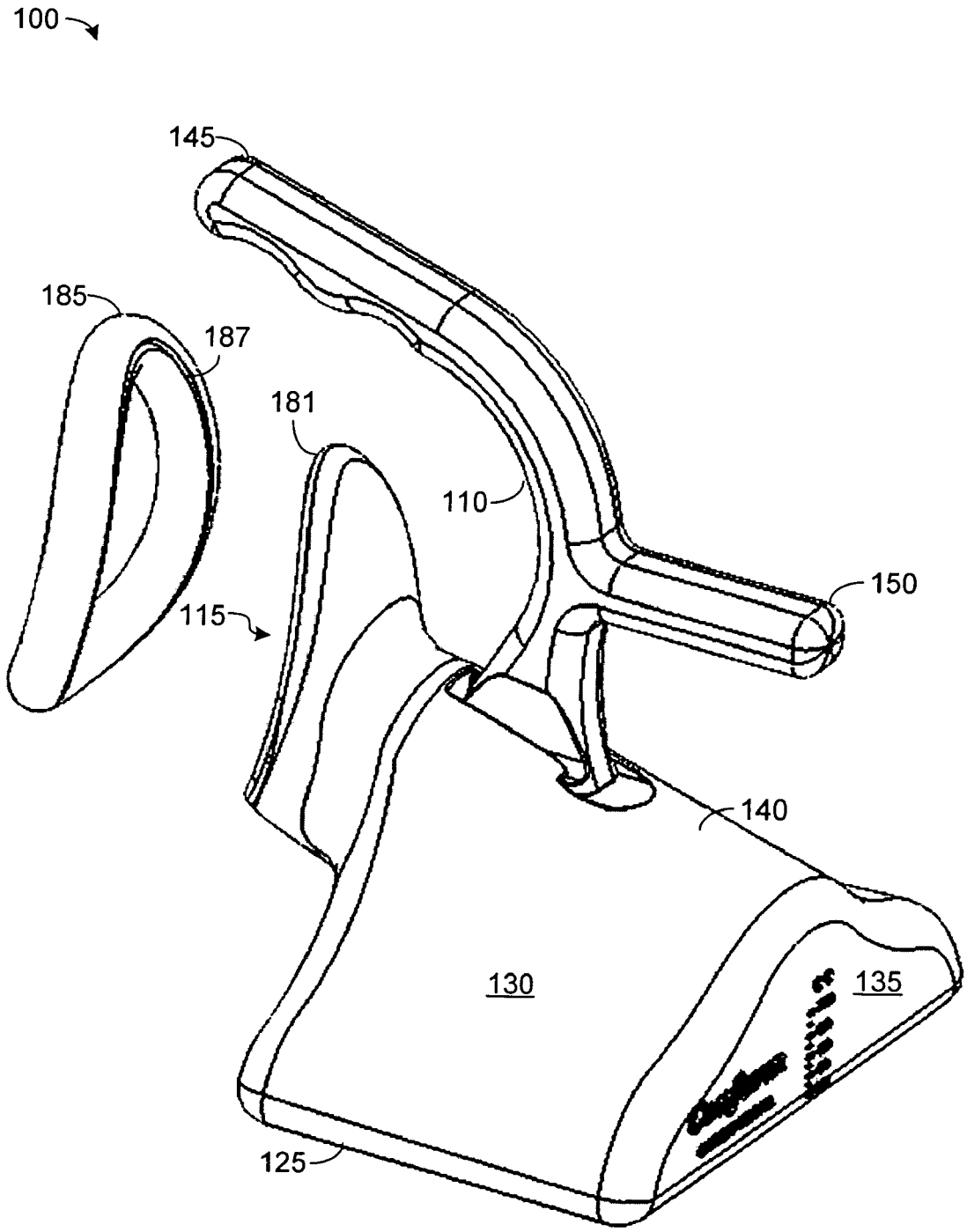
FIG. 6 depicts another embodiment of bottle 100, this one including a gasket that can be used in conjunction with bottle 100 to promote a comfortable seal.

FIG. 6 depicts another embodiment of bottle 100, this one including a gasket 185 that can be used in conjunction with bottle 100 to promote a comfortable seal. Gasket 185 includes a groove 187 that mates with the inward portion of rolled lip 181 so gasket 187 remains affixed to bottle 100. Lip 181 is comfortable by itself, but gasket 185 improves the level of comfort.

Figure 7:
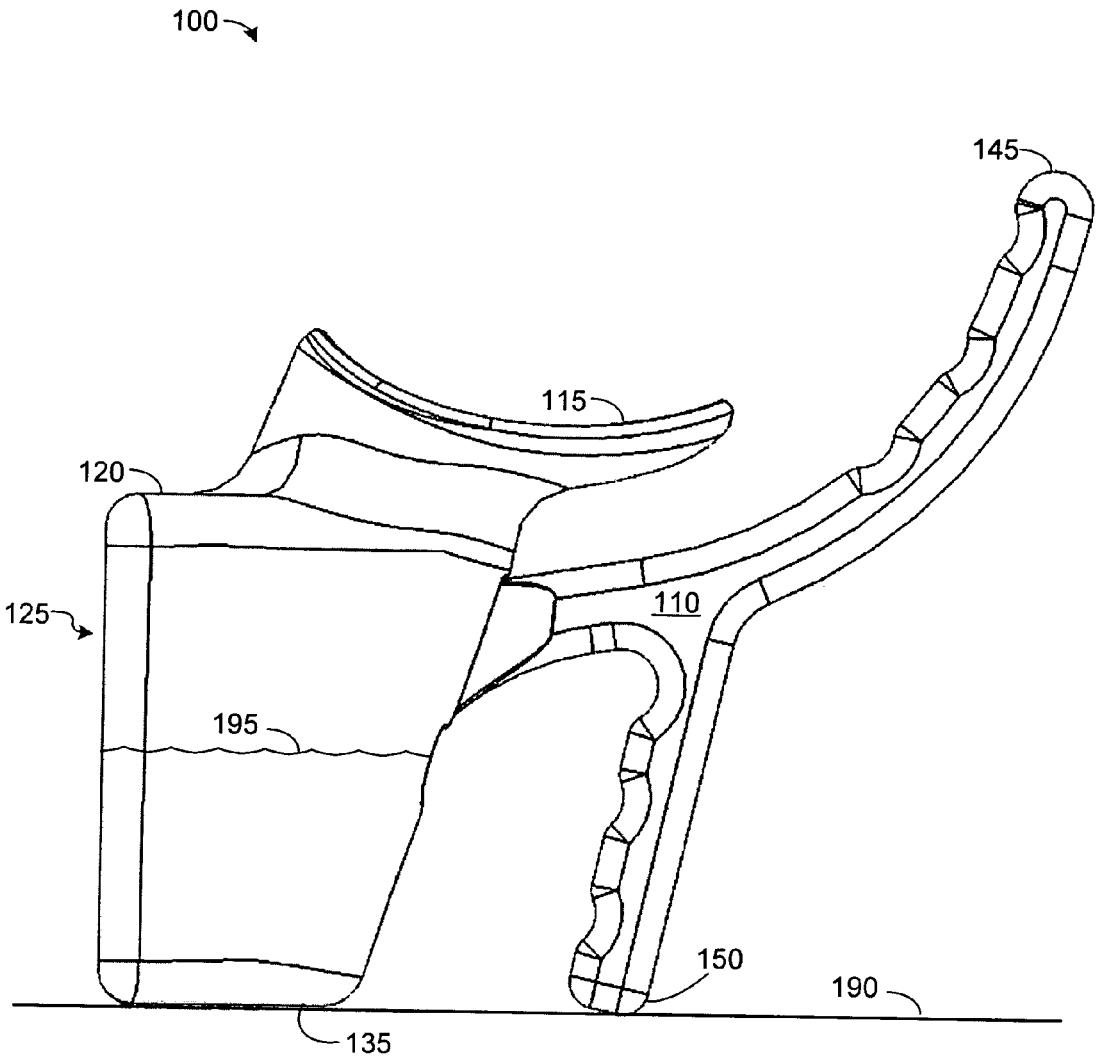
FIG. 7 depicts bottle 100 from the side and in the case the bottle is set on a table with the mouth of the bottle facing upward.

FIG. 7 depicts bottle 100 from the side and in the case in which second end 135 is placed against the surface of a table 190. Distal end 150 of handle 110 helps to stabilize bottle 100 against table 190 to prevent bottle 100 from tipping and spilling a quantity of urine 195. Graduations (not shown) on base 125 facilitate reading of the volume level of urine 195 when bottle 100 is the depicted position. The distal end of base 125, the portion contacting table 190 in the illustrative embodiment, includes at least two points of contact with table 190 that, together with the third point provided by distal end 150, form a second stable base upon which to set bottle 100. This aspect of bottle 100 allows stable bottle placement in the position shown.

While the present invention has been described in connection with specific embodiments, variations of these embodiments will be obvious to those of ordinary skill in the art. Therefore, the spirit and scope of the appended claims should not be limited to the foregoing description.

What is claimed is:

1. A urinal bottle positioned between a first leg and a second leg of a user and adapted to receive urine from the user, the urinal bottle comprising:

a. a mouth positioned against the user;

b. a body coupled to the mouth and defining an interior cavity receiving the urine via the mouth, the interior cavity including:

i. a base;

ii. a first end proximate to the mouth and extending up from the base to a first elevation;

iii. a second end opposite the mouth and extending up from the base to a second elevation, said second end forms a closed end of said body;

iv. a crest extending from the first end at the first elevation to the second end at the second elevation; and v. first and second sidewalls extending from the base to the crest;

vi. wherein the sidewalls, base crest, and ends form the body; and vii. wherein the interior cavity has:

(1) a first cross-section proximate to the first end and having a first area; and (2) a second cross-section proximate to the second end and having a second area less than the first area such that the mouth, when the bottle is positioned between the first and second legs, is urged against the user; and c. a handle connected to said body via a connecting portion extending upwardly, said handle having a proximal end extending from said connecting portion and protruding above and beyond the mouth and toward the user in a direction of the mouth, and having a distal end extending from said connecting portion opposite the direction of the mouth.

2. The urinal bottle of claim 1, wherein the base is substantially trapezoidal.

3. The urinal bottle of claim 1, wherein the legs are convex and the first and second sidewalls include respective first and second concave surfaces mating with the respective first and second legs.

4. The urinal bottle of claim 1, wherein the mouth includes a top portion having a first radius and a bottom portion having a second radius greater than the first radius.

5. The urinal bottle of claim 1, wherein the mouth includes a lip, and wherein the lip retains a gasket disposed between the mouth and the user.

6. The urinal bottle of claim 1, wherein the handle is removably connected to the crest.

7. The urinal bottle of claim 1, wherein at least a portion of the mouth is positioned between the proximal end of the handle and the base.

8. The urinal bottle of claim 1, wherein the base intersects the second end at at least two points of intersection, and wherein the distal end of the handle and the two points form a stable second base when the bottle is positioned with the distal end of the handle and the at least two points against a horizontal surface such that the mouth faces upward from the surface.

9. The urinal bottle of claim 1, wherein the second end is substantially flat.

10. The urinal bottle of claim 1, wherein the first elevation is greater than the second elevation.

11. A urinal bottle positioned between a first leg and a second leg of a user and adapted to receive urine from the user, the urinal bottle comprising:

a. a mouth positioned against the user;

b. a body coupled to the mouth and defining an interior cavity receiving the urine via the mouth, the interior cavity including:

i. a base;

ii. a first end proximate to the mouth and extending up from the base to a first elevation;

iii. a second end opposite the mouth and extending up from the base to a second elevation, said second end forms a closed end of said body;

iv. a crest extending from the first end at the first elevation to the second end at the second elevation; and v. first and second sidewalls extending from the base to the crest;

vi. wherein the sidewalls, base, crest and ends form the body; and vii. wherein the interior cavity has:

(1) a first cross-section proximate to the first end and having a first area; and (2) a second cross-section proximate to the second end and having a second area less than the first area such that the mouth, when the bottle is positioned between the first and second legs, is urged against the user;

c. a handle connected to the bottle and having a distal end extending away from the user in a direction away from the mouth;

wherein the base intersects the second end at at least two points of intersection, and wherein the distal end of the handle and the two points form a stable second base when the bottle is positioned with the distal end of the handle and the at least two points against a horizontal surface such that the mouth faces upward from the surface.

* * * * *